United States Patent [19]

Chadwick

[11] Patent Number: 4,473,948

[45] Date of Patent: Oct. 2, 1984

[54] TIRE PUNCTURING DEVICE

[76] Inventor: Thomas L. Chadwick, 8636 Encina, Fontana, Calif. 92335

[21] Appl. No.: 416,862

[22] Filed: Sep. 13, 1982

[51] Int. Cl.[3] ..... B26F 1/24

[52] U.S. Cl. ..... 30/366; 89/1 A

[58] Field of Search ..... 30/358, 366, 368, 164.8, 30/164.9; 89/1 A

[56] References Cited

U.S. PATENT DOCUMENTS

| | | | |
|---|---|---|---|
| 1,478,931 | 12/1923 | Webb | 30/164.8 |
| 1,699,970 | 1/1929 | Jacques | 30/164.8 |
| 2,102,331 | 12/1937 | Niles | 30/164.8 |
| 2,346,713 | 4/1944 | Walker | 89/1 A |
| 2,353,386 | 7/1944 | Bourcier | 89/1 A |
| 3,707,098 | 12/1972 | Kern | 30/366 X |
| 3,824,689 | 7/1974 | Hutchins | 30/368 |

FOREIGN PATENT DOCUMENTS

| | | | |
|---|---|---|---|
| 593355 | 2/1934 | Fed. Rep. of Germany | 89/1 A |
| 784754 | 4/1934 | France | 89/1 A |
| 861452 | 11/1939 | France | 89/1 A |
| 877157 | 9/1961 | United Kingdom | 30/366 |

*Primary Examiner*—Jimmy C. Peters

*Attorney, Agent, or Firm*—Harvey S. Hertz

[57] ABSTRACT

A tire puncturing device includes a plurality of drive pins which are mounted on a base plate. The pins can be forced into an automobile tire in order to puncture the tire and thus prevent the automobile from being driven. The drive pins are normally Teflon coated in order to prevent the tire from sealing onto the pins. The device is intended primarily for law enforcement officers.

2 Claims, 5 Drawing Figures

TIRE PUNCTURING DEVICE

BACKGROUND OF THE INVENTION (1) Field of the Invention

The invention relates in general to tire puncturing devices, and more particularly, to a plate member which can be attached to an automobile tire, deflating the tire and preventing the automobile from being driven.

(2) Description of the Prior Art

Conventional law enforcement requires at certain time that a automobile be disabled during crime prevention. Typically, an officer can fire his weapon and puncture the automobile tire. However, such a technique is considered dangerous due to ricocheting bullets and other hazards inherent in firing a weapon. In addition, a discharge of the firearm itself can call attention to the driver of the vehicle which is to be disabled.

Most automobile disabling techniques which are utilized to puncture tires, have been developed for military use. Typically, such an arrangement requires the dropping of massive amounts of tire puncturing devices which can stop heavily laden military vehicles from traveling on a road and can be dropped from the air as well as the ground. None prior art includes U.S. Pat. Nos. 1,203,006; 2,313,388; 2,466,707; 4,055,104; 4,096,782; 2,353,386; 2,346,713; Swiss Pat. No. 241,691, and French Pat. No. 861,452.

While certain of the patents illustrate devices which will penetrate and in turn deflate the tire of the vehicle, these devices normally are not of the type which are conducive to being carried by a law enforcement officer in a conventional manner on his belt. The present invention utilizes a tire puncturing device which can be easily utilized by a law enforcement officer to puncture a motor vehicle tire, thereby disabling the vehicle.

SUMMARY OF THE INVENTION

A tire puncturing device is formed of the base plate having a plurality of drive pins extending therefrom. The drive pin axes is perpendicular to the plane of the base plate and each of the drive pins terminate in its free end with a piercing point which is intended to penetrate the automobile tire. Typically, the drive pins are coated with polytetrafluoroethylene and is commercially available under the trademark Teflon to prevent the tire from sealing on the pins. The tire puncturing devices are normally manufactured in such a manner that a pair of the tire puncturing devices can be carried very easily by an officer and quickly removed for use.

The advantages of this invention both as to its construction and mode of operation, will be readily appreciated as the same becomes better understood by reference to the following accompanying in which like reference numerals designate like parts throughout the figures.

DESCRIPTION OF THE PREFERRED EMBODIMENTS

Figure 1:
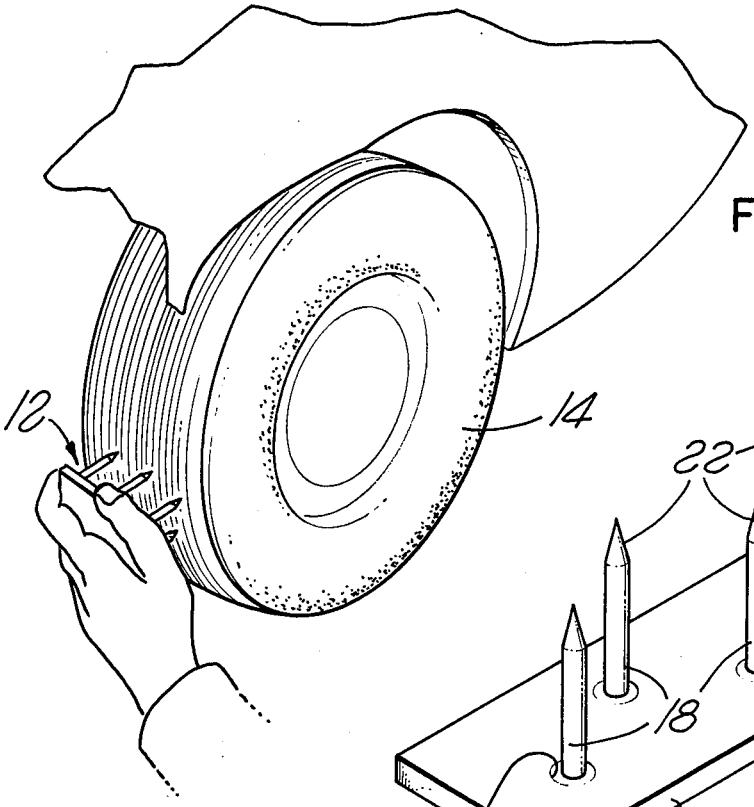
FIG. 1 is a perspective view illustrating the technique for utilizing the tire puncture device.

Referring now to the drawings, there shown in FIG. 1 a tire puncturing device 12 being utilized to penetrate a tire 14 of a motor vehicle. Typically, the tire puncturing device includes a base plate 16 having a plurality of drive pins 18 extending therefrom. The tips of the drive pins are forced into the tire as shown in FIG. 1. As the tire 14 rotates, the drive pins 18 will be forced further through the tire wall until the full depth of the tire has been penetrated. Once penetration is accomplished, air will leak from the tire and the tire will be deflated, thus disabling the vehicle.

Figure 2:
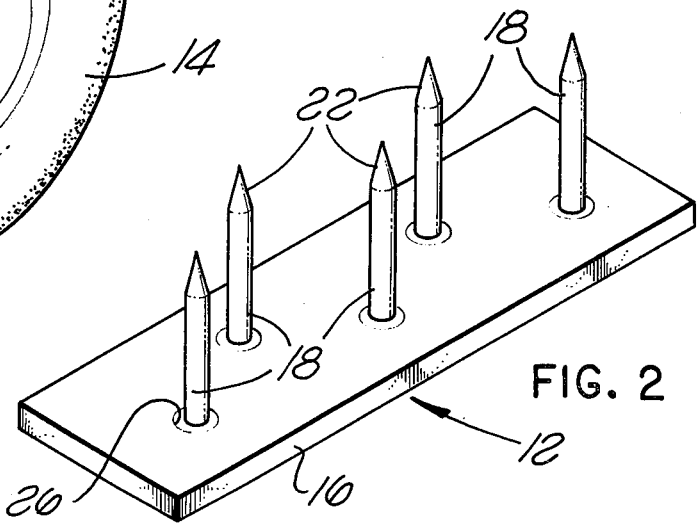
FIG. 2 is a perspective view of the tire puncturing device.
Figure 4:
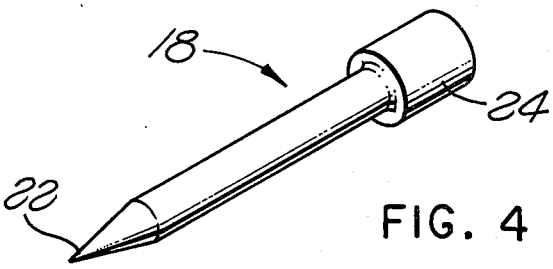
FIG. 4 is a perspective of one of the drive pins utilized in the tire puncturing device of FIG. 2.

As shown in FIG. 2 the tire puncturing device 12 includes the base plate 18 of generally rectangular configuration. A plurality of drive pins 18 extend from the base plate. Each of the drive pins 18 terminate at their free end in a pointed piercing tip 22. As shown in FIG. 4 each of the drive pins 18 include a cylindrical base 24 having a height of approximately equal to the thickness of the base plate 18 and a diameter approximately equal to apertures 26 formed in the base plate.

Figure 5:
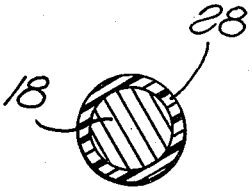
FIG. 5 is a cross sectional view of one of the drive pins of FIG. 4 taken along the line 5—5 thereof.

The drive pins 18 are inserted into the base plate so that their cylindrical base 24 forms a tight fit in the aperture 26. Then the pins are secured by conventional welding, brazing or other techniques. After the drive pins have been secured to the base plate 18, the drive pins and base plate are then sandblasted. Alternatively, the drive pins which are normally made of steel could be pre-sandblasted. Then the drive pins and base plate are sprayed with a Teflon coating 28. Then the tire puncturing device is heated to a temperature of 300 to 650 degrees until the Teflon coating is hardened. The coated drive pins 18 are shown in cross-section in FIG. 5.

It has been found that conventional drive pins or nails will normally not immediately deflate when penetrating better grade tires such as steel belted radial tires. Typically, such tires will form a temporary sealant around the nails. The Teflon coating prevents the rubber from sealing on the drive pins and thus immediately causes the automobile tire 14 to deflate.

Figure 3:
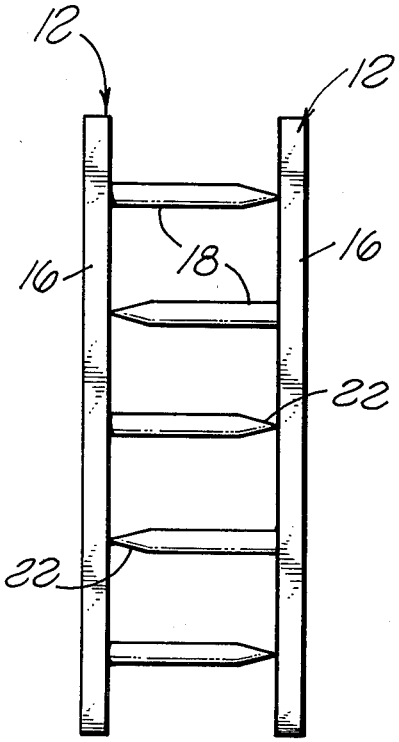
FIG. 3 is an end view illustrating a pair of tire puncturing devices of FIG. 2 positioned adjacent to each other.

Referring to FIG. 2 the drive pin arrangement is shown as two rows of pins extending longitudinally along the axes of the base plate. In the arrangement of FIG. 2 the drive pins 18 of one of the rows is interspaced between the drive pins of the adjacent row. Thus as shown in FIG. 3, a pair of tire puncturing devices 12 can be positioned with the tips of the drive pins 18 of one of the plates 16 abutting the tips 22 of the drive pins of the other plate. It has been found that such a technique can be utilized to carry or mount a pair of tire puncturing devices on the belt of a law enforcement officer. Normally the pair of tire puncturing devices would be carried in a pouch and the officer need only insert his finger beneath the top pins of both plates and both tire puncturing devices can be easily removed therefrom.

I claim:

1. A tire puncturing device comprising a base plate having a plurality of equal length drive pins whose axes are formed in a plane perpendicular to the plane of the base plate; said drive pins including a free end which forms a piercing point, said drive pins having a cylindrical base at their other ends whose height is approximately equal to the thickness of said base plate, each of said drive pins cylindrical bases being secured in an aperture formed in the base plate, said drive pin bases having a diameter greater than the diameter of the other portions of said drive pins, said drive pins being coated with polytetrafluoroethylene to prevent sealing of the pins in an automobile tire when punctured.

2. A tire puncturing device comprising a base plate having a plurality of equal length drive pins whose axes are formed in a plane perpendicular to the plane of the base plate; said drive pins including a free end which forms a piercing point, said drive pins having a cylindrical base at their other ends whose height is approximately equal to the thickness of said base plate, each of said drive pins cylindrical bases being secured in an aperture formed in the base plate, said drive pin bases having a diameter greater than the diameter of the other portions of said drive pins, said drive pins being formed of a pair of rows extending along the longitudinal plane of said base plate, said drive pins of one of said rows being offset from the drive pins of the adjacent rows and wherein said non-adjacent surfaces of said base plate are flat for enabling a pair of said puncturing devices to be carried in a pouch.

* * * * *